United States Patent [19]

Golding

[11] 3,939,860

[45] Feb. 24, 1976

[54] CLOSURE UNITS FOR CONTAINERS

[75] Inventor: Cyril George Golding, Sedgeley, England

[73] Assignee: GKN Sankey Limited, Bilston, England

[22] Filed: Apr. 3, 1975

[21] Appl. No.: 564,757

[30] Foreign Application Priority Data

Apr. 9, 1974 United Kingdom ..... 15601/74

[52] U.S. Cl. ..... 137/212; 217/99; 222/400.7

[51] Int. Cl.[2] ..... B67D 5/54; B65D 83/00

[58] Field of Search ..... 217/99, 100, 101; 137/212, 137/321, 320, 322; 251/318; 222/400.7; 220/203, 303

[56] References Cited

UNITED STATES PATENTS

| | | | |
|---|---|---|---|
| 3,036,586 | 5/1962 | Reeve | 137/212 |
| 3,361,152 | 1/1968 | Akers | 222/400.7 |
| 3,473,556 | 10/1969 | Johnson et al. | 222/400.7 |
| 3,672,390 | 6/1972 | Gravestein | 137/212 |
| 3,776,260 | 12/1973 | Ruddick | 137/212 |

FOREIGN PATENTS OR APPLICATIONS

| | | | |
|---|---|---|---|
| 296,192 | 8/1928 | United Kingdom | 217/101 |

*Primary Examiner*—William Price
*Assistant Examiner*—Allan N. Shoap
*Attorney, Agent, or Firm*—Merriam, Marshall, Shapiro & Klose

[57] ABSTRACT

A double-valved closure for a container, particularly a beer container, comprises a cup assembly for insertion into the opening of the container and includes a tubular component of plastics material having legs between which a reaction ring can be sprung during assembly of the closure. A downtube is received in the ring and extends from the lower end of the cup assembly into the container and surrounds one of the valves and a spring biasing the valve closed. The valve is carried by the top of the downtube and the reaction ring provides an abutment for the spring for this other valve and which biases the valve closed. The legs are held together after insertion of the reaction ring by means of an outer ring engaging external grooves in the legs.

14 Claims, 2 Drawing Figures

CLOSURE UNITS FOR CONTAINERS

BACKGROUND OF THE INVENTION

1. Field of the Invention

This invention relates to closure units for containers. Such closure units are particularly suitable for use with beer containers but have other applications.

2. Description of the Prior Art

More particularly, the invention is concerned with a closure unit, hereinafter referred to as being of the kind specified, for an opening in a container and comprising a cup assembly having first and second opposite ends and adapted to be received in the opening, a down-tube having an end portion within the assembly and projecting from said first end of the assembly, the down-tube providing an inner passage while an outer passage is provided between said end portion and the assembly, and inner and outer concentric valve members associated with the inner and outer passages respectively and spring biased to close said passages, the valve members being engageable from said second end of the assembly by a suitable head, e.g. a racking or dispensing head, whereby the valve members can be moved to open the passages thus permitting the connection of the passages to separate external conduits.

The object of the present invention is to provide a closure unit construction suitable for manufacture, at least partially in plastics material.

SUMMARY OF THE INVENTION

According to the invention we provide a closure unit of the kind specified wherein the cup assembly comprises (1) a component of plastics material having a collar adjacent to said second end of the assembly and a plurality of legs projecting from the collar to said first end of the assembly and (2) a reaction ring received within the legs adjacent to said first end and surrounding the down-tube, the ring forming a reaction member for the spring means acting on the outer valve member and having abutment means which are forced by the spring means into engagement with oppositely facing abutment means on the legs, the component being such that the legs are sufficiently resilient to be sprung apart to allow the ring to be inserted into position between the legs from said first end during assembly of the closure unit, and on outer ring embracing the legs adjacent to said first end to prevent the legs springing apart in the assembled closure.

The major component of the cup assembly is thus made of plastics material and allows the reaction ring to be sprung into position during assembly of the closure unit and the legs are held against springing apart in the assembled closure by means of the outer ring.

Preferably, the abutment means comprises a flange on the reaction ring and inwardly extending lugs on the legs. Preferably the reaction ring is made of plastics material and is of generally L-shape in cross section.

Preferably, each of the legs is provided with an external groove adjacent said first end of the assembly to receive the outer ring. The free end portions of the legs may also be chamfered to provide a lead for the outer ring to allow it to be sprung into position. Preferably the outer ring is of substantially D-shape in cross section and dimensioned so that when it is received in said groove its outer surface is flush with the outer surfaces of the legs.

Preferably, the outer valve member is carried by, and received within, the down-tube. Preferably the down-tube is made of plastics material and has an internal shoulder near its upper end to provide a reaction abutment for the spring means acting on the inner valve member. Said spring means is preferably engaged by a spider which in turn engages the shoulder in the down-tube. Both the spider and the inner and outer valve members are preferably formed from plastics material. Preferably, the bore of the down-tube diverges downwardly from the shoulder, this provides a convenient construction of down-tube which may easily be manufactured as will be described below.

Preferably, the collar provides an inturned lip which forms a valve seat for the outer valve member and the latter also provides a valve seat for the inner valve member.

In a preferred construction, the collar is surrounded by a metal sleeve which is externally screw-threaded so as to enable the closure unit to be threadedly engaged in an internally threaded neck on the container. In an alternative construction the collar itself may be externally threaded so as to engage directly in the neck.

BRIEF DESCRIPTION OF THE DRAWINGS

The invention will now be described in detail by way of example with reference to the accompanying drawings in which.

DESCRIPTION OF THE PREFERRED EMBODIMENT

Figure 2:
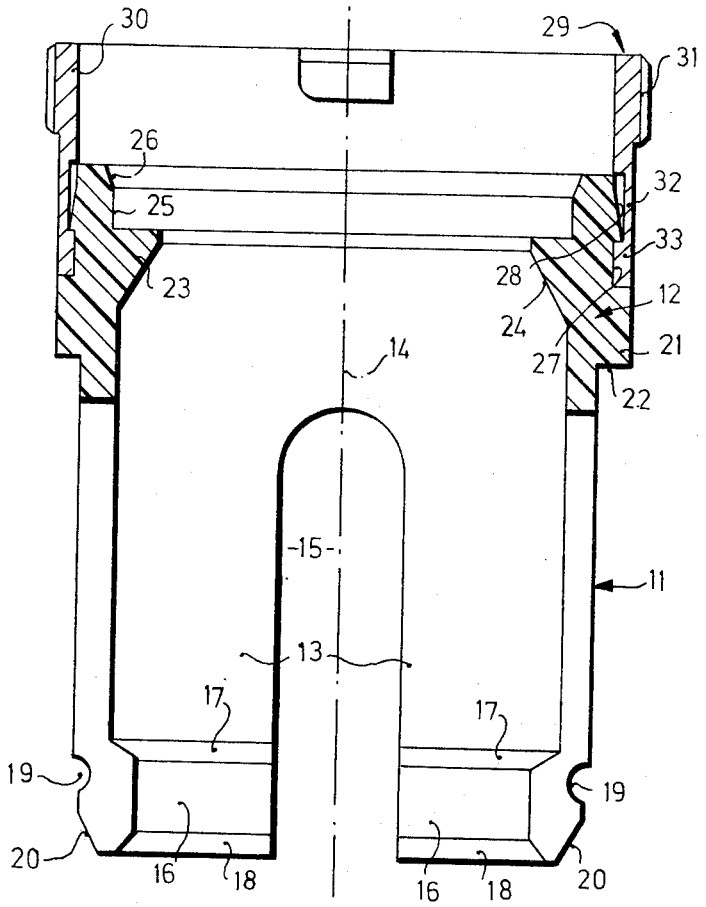
FIG. 2 is a cross section through the main plastics component of the cup assembly in combination with a metal sleeve.

Referring now to the drawings, the closure unit comprises a cup assembly indicated generally at 10. The cup assembly comprises a component 11 which is formed from plastics material and will be described in detail in relation to FIG. 2. The component comprises a collar 12 and four legs, two of which are indicated at 13, extending downwardly from the collar to the first or lower end of the assembly. The legs are equiangularly spaced about the vertical axis 14 of the component and there is a space 15 between each adjacent pair of legs. At the lower end of each leg there is provided an inturned lug 16 which has inclined upper and lower surfaces 17 and 18 respectively. Formed in the external surface of each leg, adjacent the free end thereof, is a groove 19 which is of substantially D-section. The external surface of the free end of each leg is chamfered as indicated at 20.

The collar 12 has a flange 21 with a lower surface 22 and an inturned lip 23 having a conical surface 24 which forms a valve seat for the outer valve member as will be described. A circular recess 25 is formed in the upper surface of the collar and this merges with a downwardly converging portion 26. Above the flange 21 there is a peripheral recess 27 and above that is a downwardly diverging external surface 28.

The upper part of the component 11 at the second or upper end of the assembly is surrounded by a metal sleeve indicated generally at 29. The sleeve has an upper thicker portion 30 which is provided with an external screw-thread 31. The sleeve has, below the portion 30, a thin web 32 and then a rib 33 which is a good fit within the recess 27. The sleeve 29 is assembled to the component 11 by engaging the upper end of the collar within the rib 33 and then forcing the sleeve downwardly thus deflecting the rib 33 outwardly as it moves over the surface 28. This outward movement is permitted by the flexibility of the web 32 and then the rib 33 springs into position in the recess 27.

The component 11 is made of plastics material which is sufficiently resilient to enable the legs 13 to spring inwardly and outwardly as will be described below. The sleeve 29 is of metal and may be made either of brass or stainless steel.

Figure 1:
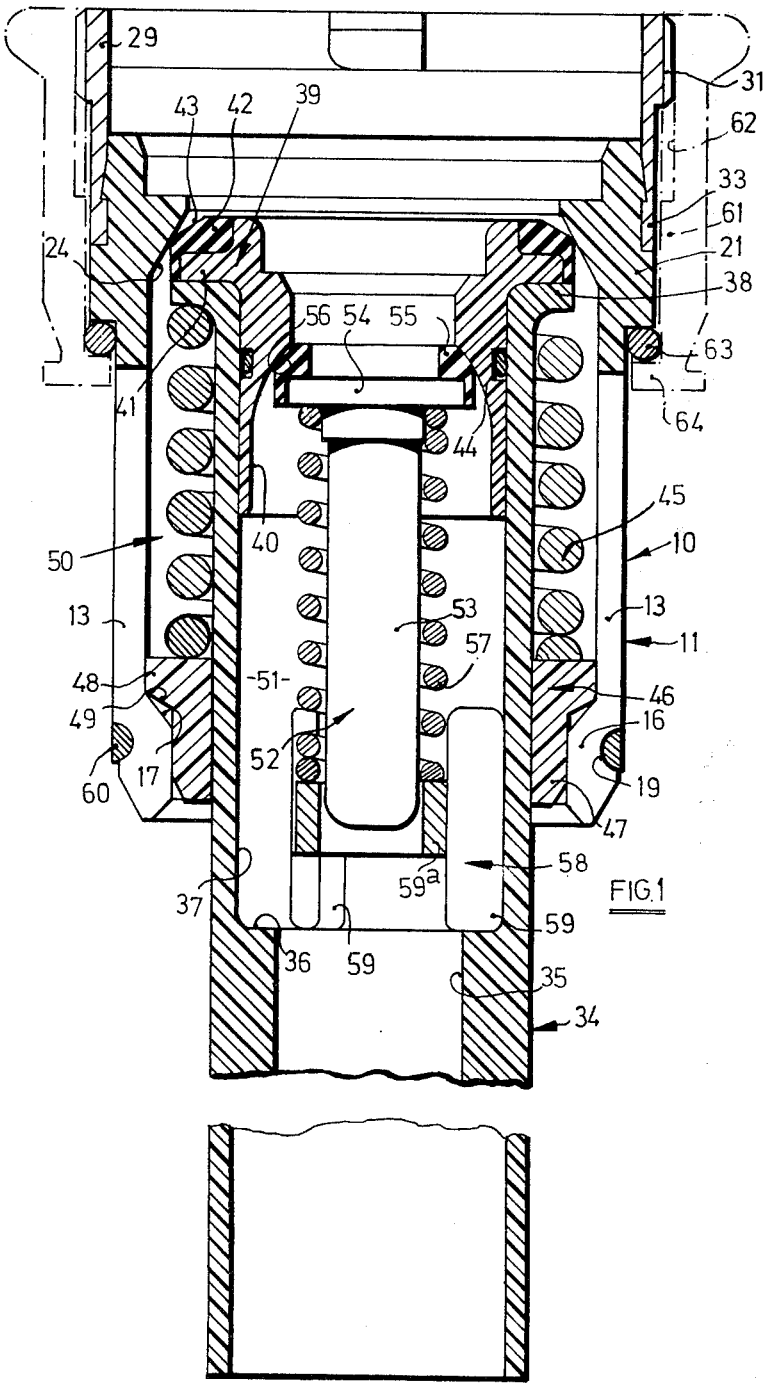
FIG. 1 is a vertical cross section through a closure unit embodying the invention showing it fitted in the neck of a container.

Referring now to FIG. 1, the unit includes a downtube 34 which is made of plastics material. The downtube has a bore, the lower part 35 of which diverges from an upwardly directed shoulder 36 to the lower end of the downtube. The upper part of the bore 37 of the downtube above the shoulder 36 is of substantially constant cross section and is cylindrical. At its upper end, the downtube has an outwardly directed flange 38.

An outer valve member 39 is received within the upper end of the down-tube and has a skirt 40, which is received within the bore part 37, and a flange 41 which overlies the flange 38. The flange 41 has bonded thereto a rubber ring 42 of generally L-section and which has a chamfered surface 43. The skirt 40 is sealed within the down-tube bore part 37 by means of a sealing ring 44 which is received in an external groove in the valve member. A spring 45 engages at its upper end under the flange 38 of the down-tube and at its lower end it engages a reaction ring indicated generally at 46. The reaction ring is of generally inverted L-section and has a generally cylindrical portion 47 which is received within the lugs 16 and has a flange 48 which engages the upper inclined surfaces 17 of the lugs 16. The reaction ring 46 thus provides a reaction abutment for the lower end of the spring 45 which urges the outer valve member 39 upwardly so that its rubber ring 42 is in engagement with the conical surface 24 on the component 11. The space between the down-tube 34 and the legs 13 provides an outer passage 50.

An inner passage 51 is provided within the bore portion 37 of the down-tube and within this inner passage is mounted an inner valve member indicated generally at 52. The inner valve member has a shank 53 and a head 54 which has moulded thereto a rubber ring 55 of generally L-shape having an upper chamfered surface. This rubber ring engages a generally conical valve seat 56 on the outer valve member 39 and is forced into engagement with the valve seat by means of a spring 57 which closely surrounds the shank 53 and engages at its lower end with a spider indicated generally at 58 and which has three legs 59 which rest on the shoulder 36 in the down-tube. The legs 59 are equiangularly spaced about, and are secured to, a central collar **59*a* which receives the shank 53 with clearance and the lower end of the spring 57 engages the upper end of the collar 59*a*.**

The inner valve member 52 and the outer valve member 39 are preferably made of plastics material as is the spider 58.

A metal ring 60, preferably of stainless steel, is received in the grooves 19 in the legs 13 and prevents them from springing apart. It will be noted that the ring 60 is of substantial D-cross section so that its outer surface is generally flush with the outer surfaces of the upper parts of the legs 13.

The closure is received within the neck of a container e.g. a beer container, the neck being shown in dotted lines at 61. The neck has an internal screw thread 62 with which the screw thread 31 on the sleeve 29 engages. A rubber setting ring 63 is engaged between the flange 21 on the component 11 and an inturned flange 64 on the neck. It will be seen that the sleeve 29 is screwed downwardly into the neck, the ring 63 will be compressed and in fact the flange 21 of the component will be compressed between the rib 33 on the sleeve and the ring 63.

The operation of the valve is conventional, thus a racking or dispensing head can be received in the recess 25 and parts thereof will engage the outer valve member 39 and inner valve member 51 and will move them downwardly against their springs 45 and 57 thus to open the outer and inner passages 50 and 51 and allow these to be connected to separate passages in the head body. Gas will be supplied from the head and will flow passed the valve member 39 into the outer passage 50 and between the legs 13 and into the container. The gas forces the liquid e.g. beer, up the downtube 34, between the legs of the spider and past the inner valve member 51 into a passage in the head.

The closure unit is assembled as follows. Firstly, the sleeve 29 is assembled onto the component 11 in the manner described above. The spider 58 is then inserted into the down-tube so that it rests on the shoulder 36 and the inner and outer valve members 52 and 39 are inserted into the inner end of the down-tube together with the spring 57. The down-tube is then inserted into the component 11 from the lower end thereof, the assembly is preferably carried out with the component inverted but the description will be made referring to the fitting in the position shown in FIG. 1. The spring 45 is then placed in position after which the reaction ring 46 is placed in position. The legs 13 are sufficiently resilient to allow them to spring apart to allow the flange 48 on the reaction ring to pass the lugs 16 at the free ends of the legs. A tool is then slipped over the down-tube and compresses the spring 45 and moves the reaction ring 46 upwardly so that its skirt 47 is clear of the lugs 16. The free end portions of the legs are then sprung towards one another and the ring 60 is sprung into position in the grooves 19. The spring 45 is then allowed to expand pushing the reaction ring to the position shown in FIG. 1 to provide a reaction for the spring 45.

As described, the whole of the fitting is made of plastics material with the exception of the springs 45 and 57 the sleeve 29 and ring 60. It is, however, within the scope of the invention to make any of the parts of metal except for the component 11 although it is preferred that a substantially completely plastic valve is used. The down-tube of the design shown can conveniently be moulded from plastics material by having two cores which are withdrawable from opposite ends. Thus there will be a first cylindrical core which will form the bore part 37 and a second tapered bore which will form the bore part 35 and which can be withdrawn from the lower end of the down-tube due to the taper.

It will be seen that the valve is easily made and assembled and may easily be disassembled for cleaning purposes by inserting a tool over the down-tube and pushing the reaction ring 46 upwardly to compress the spring and then springing the legs together and removing the ring 60 whereupon the reaction ring can be removed and all the other parts removed in the reverse order to that described above.

Preferably the valves 39 and 52 are made of nylon, for example glass-reinforced, high temperature nylon such as that sold by Imperial Chemical Industries Limited under the Trade Mark Maranyl. Preferably the other plastic parts, i.e. the component 11, the downtube 34 and the reaction ring 46 are made of an acetal resin. Suitable resins are the homopolymer known as Delrin sold by Dupont or the copolymer sold by Amcel Limited and known as Chemetal.

I claim:

1. A closure unit for an opening in a container comprising a cup assembly having first and second opposite ends and adapted to be received in the opening, a downtube having an end portion within the assembly and projecting from said first end of the assembly, the down-tube providing an inner passage while an outer passage is provided between said end portion and the assembly, and inner and outer concentric valve members associated with the inner and outer passages respectively and spring biased to close said passages, wherein the cup assembly comprises (1) a component of plastics material having a collar adjacent to said second end of the assembly and a plurality of legs projecting from the collar to said first end of the assembly and (2) a reaction ring received within the legs adjacent to said first end and surrounding the downtube, the ring forming a reaction member for the spring means acting on the outer valve member and having abutment means which are forced by the spring means into engagement with oppositely facing abutment means on the legs, the component being such that the legs are sufficiently resilient to be sprung apart to allow the ring to be inserted into position between the legs from said first end during assembly of the closure unit, and an outer ring embracing the legs adjacent to said first end to prevent the legs springing apart in the assembled closure.

2. A unit according to claim 1 wherein the abutment means comprises a flange on the reaction ring and inwardly extending lugs on the legs.

3. A unit according to claim 1 wherein the reaction ring is made of plastics material and is of generally L-shape in cross section.

4. A unit according to claim 1 wherein each of the legs is provided with an external groove adjacent said first end of the assembly to receive the outer ring.

5. A unit according to claim 4 wherein the free end portions of the legs are chamfered to provide a lead for the outer ring during assembly of the unit.

6. A unit according to claim 4 wherein the outer ring is of substantially D-shape in cross section and is dimensioned so that when it is received in said grooves its outer surface is flush with the outer surfaces of the legs.

7. A unit according to claim 1 wherein the outer valve member is carried by, and received within, the downtube.

8. A unit according to claim 1 wherein the downtube is made of plastics material and has an internal shoulder near its upper end to provide a reaction abutment for the spring means acting on the inner valve member.

9. A unit according to claim 8 wherein the spring means for the inner valve member is engaged by a spider which in turn engages said shoulder.

10. A unit according to claim 8 wherein the bore of the down-tube diverges downwardly from the shoulder.

11. A unit according to claim 1 wherein the collar provides an inturned lip which forms a valve seat for the outer valve member and wherein the latter also provides a valve seat for the inner valve member.

12. A unit according to claim 1 wherein the collar is surrounded by a metal sleeve which is secured to the collar and which is externally screwthreaded.

13. A unit according to claim 1 wherein the collar is externally screwthreaded for engagement in an opening in a container.

14. A combination of a unit according to claim 1 with a container and in which the unit is received in an opening in a container.

* * * * *